US010240332B1

(12) United States Patent
Stetson

(10) Patent No.: US 10,240,332 B1
(45) Date of Patent: Mar. 26, 2019

(54) CHANNEL DRAIN

(71) Applicant: Stetson Development, Inc., Canyon Lake, CA (US)

(72) Inventor: Michael A. Stetson, Canyon Lake, CA (US)

( * ) Notice: Subject to any disclaimer, the term of this patent is extended or adjusted under 35 U.S.C. 154(b) by 0 days.

(21) Appl. No.: 15/877,884

(22) Filed: Jan. 23, 2018

(51) Int. Cl.

| | |
|---|---|
| ***E02B 13/00*** | (2006.01) |
| ***E03F 1/00*** | (2006.01) |
| ***E02B 11/00*** | (2006.01) |
| ***A01G 25/06*** | (2006.01) |
| ***E03F 5/06*** | (2006.01) |

(52) U.S. Cl.
CPC ..... *E03F 5/06* (2013.01); *E02B 11/005* (2013.01)

(58) Field of Classification Search
CPC ..... A01G 25/06; A01G 2025/003; B01D 2221/12; C02F 2103/001; E01C 11/221; E01C 11/222; E01C 11/223; E01C 11/224; E01C 11/225; E01C 11/227; E01C 11/228; E01C 11/229; E02B 5/00; E02B 11/00; E02B 11/005; E02B 13/00; E02D 3/10; E02D 5/02; E02D 5/04; E02D 29/0216; E03B 3/02; E03F 1/00; E03F 1/002; E03F 1/003; E03F 3/046; E03F 5/04; E03F 5/0401; E03F 5/0404; E03F 5/0406; E03F 5/06; E03F 5/10; E03F 5/14; Y10T 137/1866
USPC ..... 405/36–51, 107–127; 404/2–5; 210/170.01–170.11
See application file for complete search history.

(56) References Cited

U.S. PATENT DOCUMENTS

| | | | | | |
|---|---|---|---|---|---|
| 601,794 | A * | 4/1898 | Hershberger | E02B 13/00 | 405/40 |
| 674,896 | A * | 5/1901 | Blueher | E02B 13/00 | 405/41 |
| 780,189 | A * | 1/1905 | Jaeckel | E02B 13/00 | 138/103 |
| 1,052,226 | A * | 2/1913 | Douglas | E02B 13/00 | 138/163 |
| 1,153,332 | A * | 9/1915 | Naylor | E02B 13/00 | 405/39 |
| 1,401,097 | A * | 12/1921 | Nickolaus | E02B 13/00 | 251/145 |
| 1,413,528 | A * | 4/1922 | Dutcher | E02B 13/00 | 405/122 |
| 1,494,847 | A * | 5/1924 | Knight | E03F 1/003 | 138/103 |

(Continued)

*Primary Examiner* — Benjamin F Fiorello
*Assistant Examiner* — Edwin J Toledo-Duran
(74) *Attorney, Agent, or Firm* — Stetina Brunda Garred & Brucker

(57) ABSTRACT

A channel drain for use in a fabricated surface having an exposed appearance. The channel drain includes a first body having a plurality of support surfaces, with each support surface extending from a respective body sidewall in spaced relation to a body lower wall. A plurality of inserts are insertable into the first body. Each insert includes an insert cavity sized and structured to receive a selected material having an appearance substantially identical to the exposed appearance of the fabricated surface. Each insert is supported by certain ones of the plurality of support surfaces when inserted into the first body and is sized and structured to define a gap between the pair of body sidewalls when inserted into the first body, with the gap allowing for fluid to flow therethrough toward the body lower wall.

19 Claims, 7 Drawing Sheets

(56) References Cited

U.S. PATENT DOCUMENTS 2,386,020 A * 10/1945 Wendelken ..... E01C 11/227 404/2
3,048,911 A * 8/1962 Almon ..... E04G 15/00 138/89
3,183,674 A * 5/1965 Boschen ..... E02B 13/00 405/37
3,625,011 A * 12/1971 Stevenson ..... E01C 13/02 404/2
3,645,100 A * 2/1972 La Monica ..... C02F 3/046 405/46
3,849,991 A * 11/1974 Niederwemmer ..... E02B 13/00 261/78.2
4,051,373 A * 9/1977 Hatch ..... G01T 1/1642 250/363.02
4,119,751 A * 10/1978 Nilsson ..... F16L 59/15 138/103
4,367,974 A * 1/1983 Beanland ..... E01C 11/223 404/5
4,456,397 A * 6/1984 Freis ..... E02D 29/1427 404/25
4,462,123 A * 7/1984 Morris ..... E03F 5/0407 4/286
4,499,695 A * 2/1985 Oger ..... E02D 29/1427 404/25
4,630,962 A * 12/1986 Thomann ..... E01C 11/227 210/163
4,649,674 A * 3/1987 Gaul ..... E02D 29/1409 210/165
4,883,590 A * 11/1989 Papp ..... E03F 5/0407 210/164
4,919,564 A * 4/1990 Neathery ..... E02D 29/14 277/648
4,993,877 A * 2/1991 Beamer ..... E01C 19/506 249/10
5,123,776 A * 6/1992 Lang ..... E02D 29/14 404/25
5,205,668 A * 4/1993 Adams ..... E02D 29/14 404/26
5,209,601 A * 5/1993 Odill ..... E02D 29/14 404/26
5,223,154 A * 6/1993 MacPherson, Jr. .. B01D 24/002 210/790
5,240,346 A * 8/1993 Yin ..... E02D 29/149 404/25
5,362,174 A * 11/1994 Yang ..... E02D 29/14 404/25
5,549,411 A * 8/1996 Hawkins ..... E02D 29/14 404/25
5,564,855 A * 10/1996 Anderson ..... E02D 29/1409 404/26
5,568,995 A * 10/1996 Beamer ..... E03F 3/046 404/4
5,573,351 A * 11/1996 Beamer ..... E03F 3/046 249/11
5,702,204 A * 12/1997 Gunter ..... E03F 3/046 404/2
5,711,536 A * 1/1998 Meyers ..... E03F 5/02 277/606
5,769,564 A 6/1998 Hawkins
5,827,007 A * 10/1998 Barton ..... E02D 29/12 404/25
5,899,024 A * 5/1999 Stannard ..... E02D 29/1409 404/26
5,951,200 A 9/1999 Barton
5,996,612 A * 12/1999 Crawford ..... E02D 29/1409 137/364
5,997,212 A * 12/1999 Takada ..... E02D 29/14 404/19
6,035,581 A * 3/2000 McCoy ..... E02D 29/1427 404/25
6,381,775 B1 * 5/2002 Sondrup ..... E03C 1/22 210/163
6,393,771 B1 * 5/2002 Stetson ..... E02D 29/14 404/25
6,698,977 B1 * 3/2004 Charon ..... E02B 5/02 210/170.1
6,727,992 B2 * 4/2004 Hill ..... G03F 7/70775 356/492
6,799,606 B1 * 10/2004 Howson ..... E04D 13/0409 138/89
7,223,051 B1 * 5/2007 Vought ..... E02D 29/12 405/154.1
7,361,834 B1 * 4/2008 Trangsrud ..... H02G 3/14 174/66
7,451,570 B1 * 11/2008 Gavin ..... E02D 29/14 52/19
7,574,831 B2 8/2009 Meyers
7,627,992 B1 * 12/2009 Gavin ..... E02D 29/12 174/39
7,695,213 B1 * 4/2010 Akkala ..... E02D 29/1427 404/25
7,788,743 B2 * 9/2010 Mjelde ..... E04H 4/1236 4/286
7,862,729 B2 1/2011 Stetson
8,333,885 B1 * 12/2012 Iorio ..... C02F 3/327 210/150
8,833,387 B2 * 9/2014 Lucas ..... E03F 5/0407 137/362
2002/0150428 A1 * 10/2002 Rhodes ..... E02B 11/00 405/36
2002/0166291 A1 * 11/2002 Campbell ..... E02D 29/14 52/20
2003/0145527 A1 * 8/2003 Meyers ..... E02D 29/12 52/20
2008/0044225 A1 * 2/2008 Swartz ..... E02D 29/1445 404/25
2008/0189926 A1 * 8/2008 Luxton ..... E03F 5/0408 29/428
2008/0260460 A1 * 10/2008 Nolle ..... E02D 29/14 404/25
2008/0272038 A1 * 11/2008 Stetson ..... E01C 11/227 210/164
2009/0180832 A1 * 7/2009 Vrondran ..... E02D 29/1427 404/25
2011/0162137 A1 * 7/2011 Kik, Sr. ..... E03F 3/046 4/613
2011/0203979 A1 * 8/2011 Schlueter ..... E03F 5/04 210/164
2012/0036629 A1 * 2/2012 Cook ..... E03F 5/0407 4/613
2015/0322638 A1 * 11/2015 Suazo ..... E02B 3/12 405/118
2016/0060818 A1 * 3/2016 Campbell ..... E01C 11/223 138/109
2016/0122999 A1 * 5/2016 Curtis ..... E04B 1/6801 52/395
2016/0369491 A1 * 12/2016 Eftekharzadeh ..... E03F 1/003
2017/0175374 A1 * 6/2017 Funari ..... E03F 5/0401

* cited by examiner

CHANNEL DRAIN

CROSS-REFERENCE TO RELATED APPLICATIONS

Not Applicable

STATEMENT RE: FEDERALLY SPONSORED RESEARCH/DEVELOPMENT

Not Applicable

BACKGROUND

1. Technical Field

The present disclosure relates generally to a channel drain, and more specifically to a channel drain for use in a fabricated surface, wherein the channel drain includes a cavity sized and structured to receive a quantity of material having an appearance which may be substantially identical to the fabricated surface to allow the channel drain to blend into the fabricated surface.

2. Description of the Related Art

Channel drains may refer to a floor or surface drain having a trough or channel shaped body located below an exposed upper surface. An elongate void may be formed in the exposed upper surface above the trough or channel to allow water to flow from the exposed upper surface into the trough. A grate may extend over the opening, with the grate being structured to allow water to flow therethrough and into the trough for drainage, while at the same time providing a structure upon which individuals may walk or otherwise be supported when traversing across the floor or surface.

It is common to incorporate channel drains in areas which are landscaped or designed to have an aesthetically pleasing appearance. For instance, commercial properties, resorts, residential properties, etc., may include areas intended to have aesthetic appeal, while at the same time requiring drainage. In this respect, the channel drain may be formed in a fabricated surface including colored concrete, aggregate, tile, stone, or other hardscaping material known in the art.

However, the existence of the channel drain may create an undesirable appearance in the fabricated surface, and disrupt an otherwise aesthetically appearing surface. In particular, the grate may formed of metal, plastic, rubber or the like, which may create an unwanted visual contrast with the material used to form the fabricated surface.

Accordingly, there is a need in the art for a more aesthetically appearing drain channel for use in a fabricated surface. Various aspects of the present disclosure address this particular need, as will be discussed in more detail below.

BRIEF SUMMARY

In accordance with one embodiment of the present disclosure, there is provided a channel drain for use in a fabricated surface having an exposed appearance. The channel drain includes a first body having a body lower wall and a pair of body sidewalls extending from the body lower wall in opposed relation to each other. The first body additionally includes a plurality of support surfaces, with each support surface extending from a respective one of the pair of body sidewalls in spaced relation to the body lower wall. The channel drain further comprises a plurality of inserts insertable into the first body. Each insert includes an insert lower wall, and a pair of insert sidewalls extending from insert lower wall in opposed relation to each other. The pair of insert sidewalls and the insert lower wall at least partially define an insert cavity sized and structured to receive a selected material having an appearance substantially identical to the exposed appearance of the fabricated surface. Each insert is supported by certain ones of the plurality of support surfaces when inserted into the first body and is sized and structured to define a gap between the pair of body sidewalls when inserted into the first body, with the gap allowing for fluid to flow therethrough toward the body lower wall.

The first body may include a plurality of side cavities, with each side cavity extending into the first body from a respective one of the pair of sidewalls.

The channel drain may additionally comprise a pair of flanges extending from respective ones of the pair of sidewalls, with each flange having at least one aperture formed therein.

Each insert may include at least one aperture formed in the insert lower wall.

The channel drain may further include an end cap engageable with the body lower wall and the pair of body sidewalls and extending between the pair of body sidewalls when engaged therewith.

The channel drain may also comprise a drain connector engageable with the body lower wall and the pair of body sidewalls. The drain connector may have a primary wall extending between the pair of body sidewalls, with the primary wall having a drain opening formed in the primary wall. A sleeve may extend from the primary wall and in fluid communication with the drain opening.

The channel drain may further include a spacer engagable with the pair of body sidewalls, with the spacer being sized and structured to provide lateral support to the pair of body sidewalls to maintain a prescribed distance therebetween.

The channel drain may also include a second body connectable to the first body. The second body may have a body lower wall, a pair of body sidewalls extending from the body lower wall in opposed relation to each other, and a plurality of support surfaces, with each support surface extending from a respective one of the pair of body sidewalls in spaced relation to the body lower wall. The channel drain may additionally include a connector frictionally engageable with the second body and the first body to facilitate connection of the second body to the first body.

According to another embodiment, there is provided a channel drain for use in a fabricated surface formed of a selected material. The channel drain includes a main body having an upper edge and defining a drainage flowpath, with the main body being positionable in the fabricated surface such that the upper edge is substantially flush with the fabricated surface. The channel drain additionally includes a plurality of inserts insertable into the main body, with each insert having a cavity sized and configured to receive the selected material to create an exposed surface substantially identical to the fabricated surface. The main body and the plurality of inserts collectively define a gap between the plurality of inserts and the main body when the plurality of inserts are inserted within the main body, the gap being sized and structured to allow for fluid drainage therethrough to the drainage flowpath in the main body.

The main body may include a plurality of support surfaces, with each insert being supported by certain ones of the support surface upon insertion of the insert into the main body. The main body may additionally comprise opposed lateral portions and a plurality of recesses formed therein, with each recess extending into the main body from a respective one of the lateral portions.

According to yet another embodiment, there is provided a method of installing a channel drain in a fabricated surface having an exposed appearance. The method comprises the steps of: positioning a first body within the fabricated surface, and inserting a plurality of inserts within the first body.

The positioning step may include attaching the first body to a concrete form, and pouring concrete adjacent the first body to form the fabricated surface.

The positioning step may include inserting a spacer within the first body prior to pouring the concrete, with the spacer being sized and structured to provide lateral support to the pair of body sidewalls to maintain a prescribed distance therebetween while concrete is poured adjacent the first body.

The positioning step may include inserting the first body within fabricated surface after it has been formed.

The method may additionally include disposing the selected material in the insert cavity of each insert.

The present disclosure will be best understood by reference to the following detailed description when read in conjunction with the accompanying drawings.

BRIEF DESCRIPTION OF THE DRAWINGS

These and other features and advantages of the various embodiments disclosed herein will be better understood with respect to the following description and drawings, in which.

DETAILED DESCRIPTION

Figure 1:
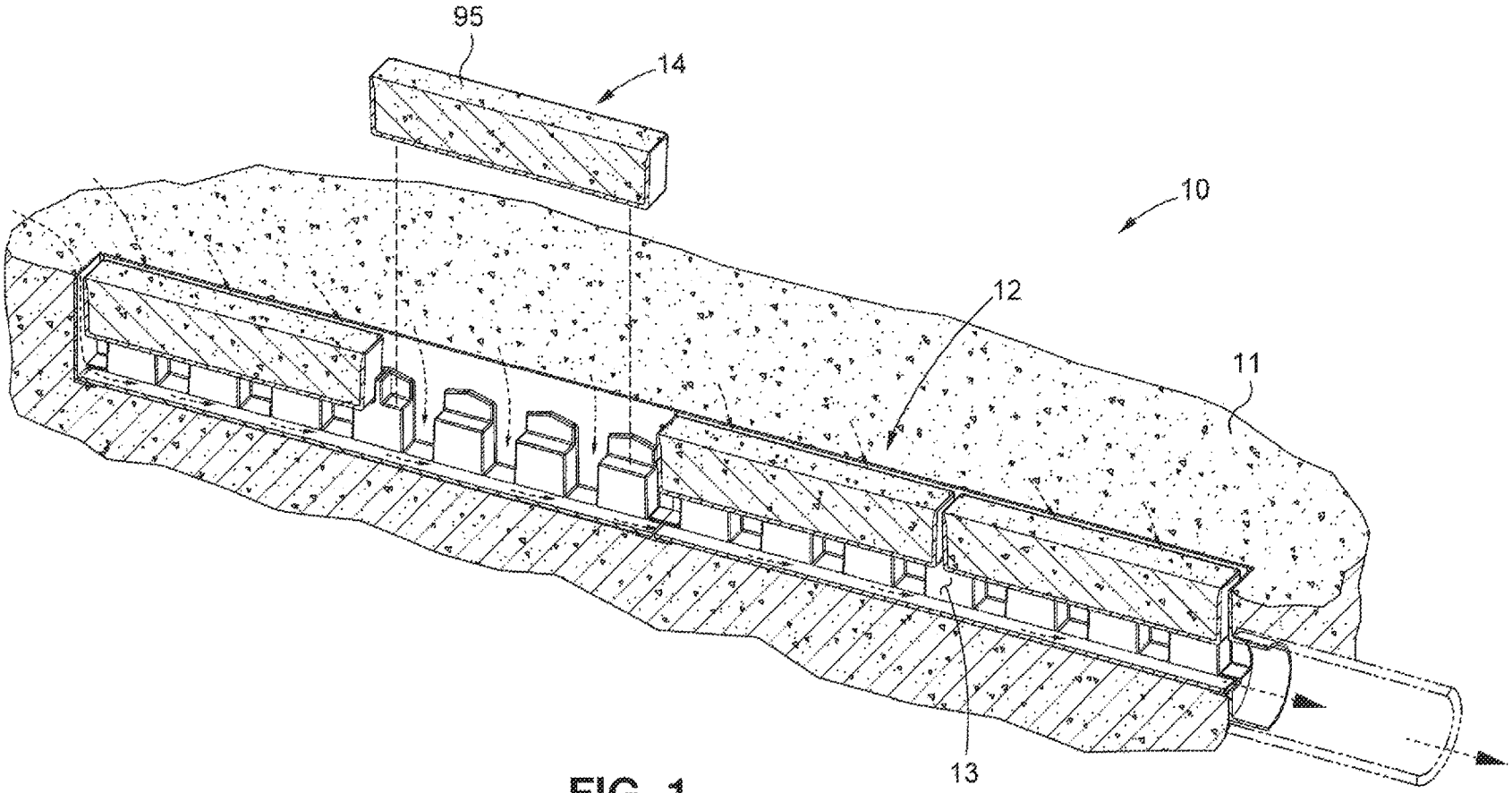
FIG. 1 is an upper perspective, cross sectional view of the channel drain installed within a fabricated surface, with one insert removed from a drain base.

The detailed description set forth below in connection with the appended drawings is intended as a description of certain embodiments of a channel drain and is not intended to represent the only forms that may be developed or utilized. The description sets forth the various structure and/or functions in connection with the illustrated embodiments, but it is to be understood, however, that the same or equivalent structure and/or functions may be accomplished by different embodiments that are also intended to be encompassed within the scope of the present disclosure. It is further understood that the use of relational terms such as first and second, and the like are used solely to distinguish one entity from another without necessarily requiring or implying any actual such relationship or order between such entities.

Referring now to the drawings, wherein the showings are for purposes of illustrating a preferred embodiment of the present disclosure, and are not for purposes of limiting the same, there is depicted a channel drain 10 for use in a fabricated surface 11 having an exposed appearance. The channel drain 10 is designed to create an appearance which may be complimentary to the fabricated surface, and which may reduce the disruption of the exposed appearance. Thus, the channel drain may blend in to the fabricated surface 11, while at the same time functioning in a manner to conventional channel drains by including a gap which leads to a drainage flowpath 13 to allow fluid to drain off of the fabricated surface 11.

Figure 2:
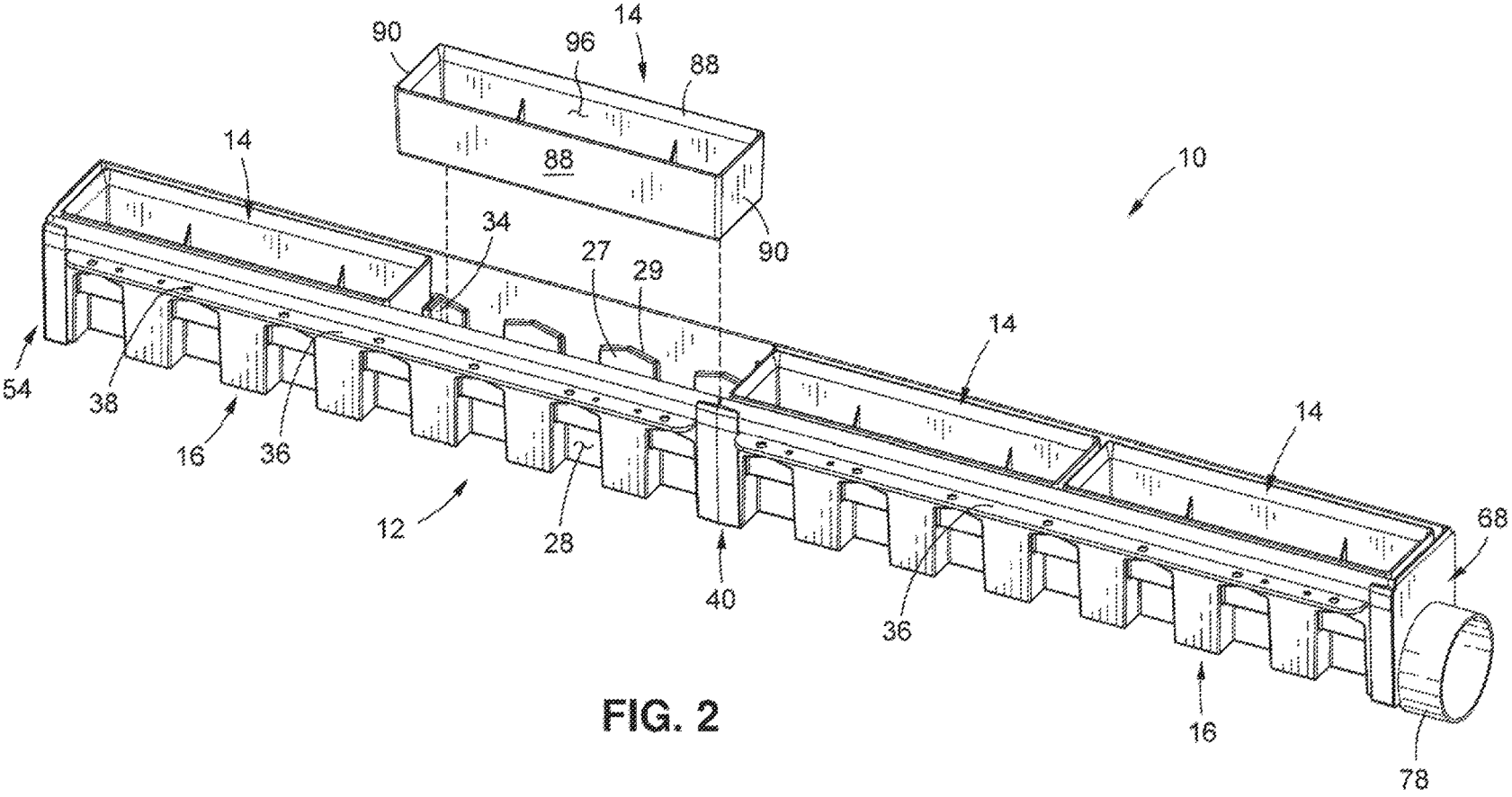
FIG. 2 is an upper perspective view of a channel drain constructed in accordance with one embodiment of the present disclosure.
Figure 3:
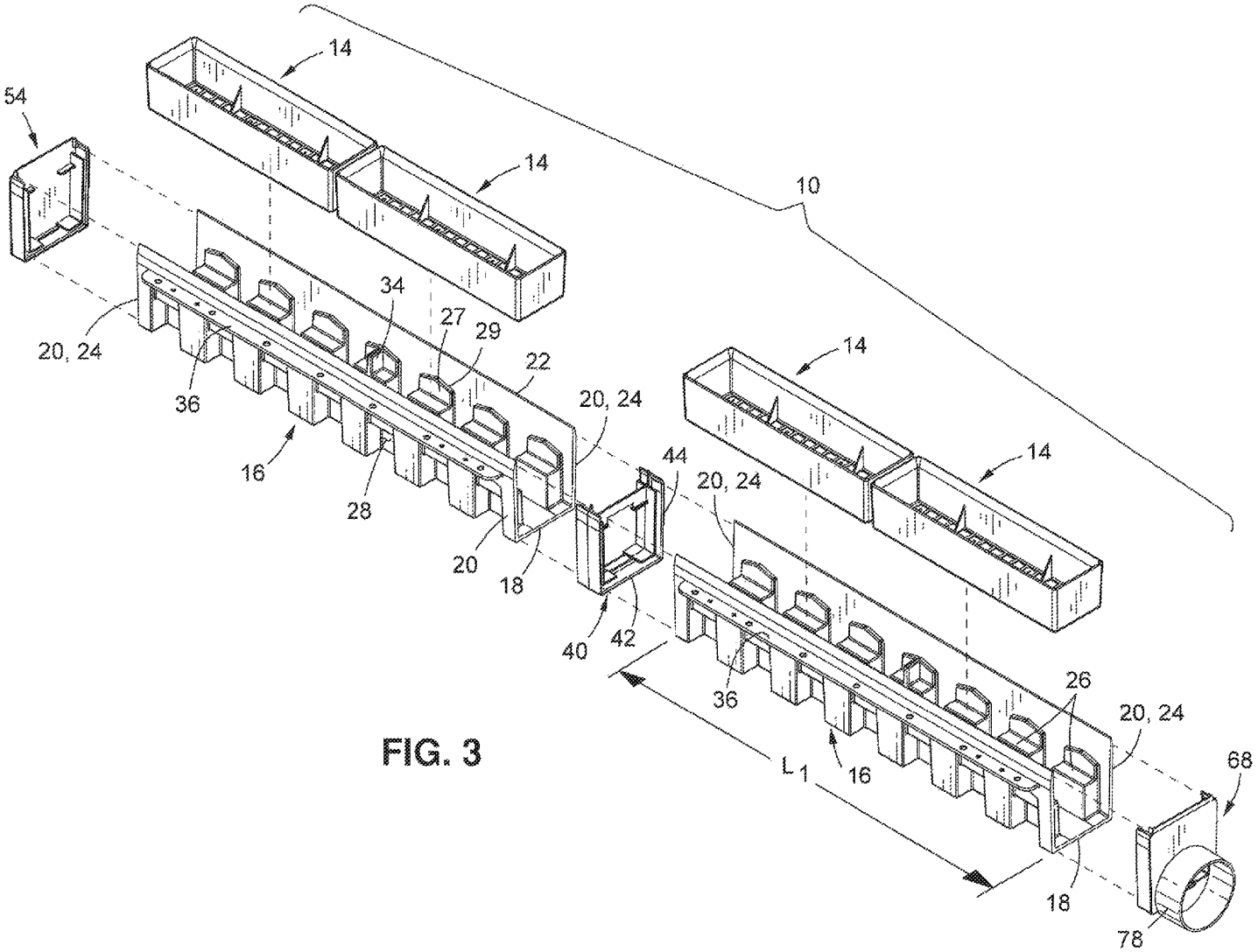
FIG. 3 is an upper perspective, exploded view of the channel drain of FIG. 2.
Figure 5:
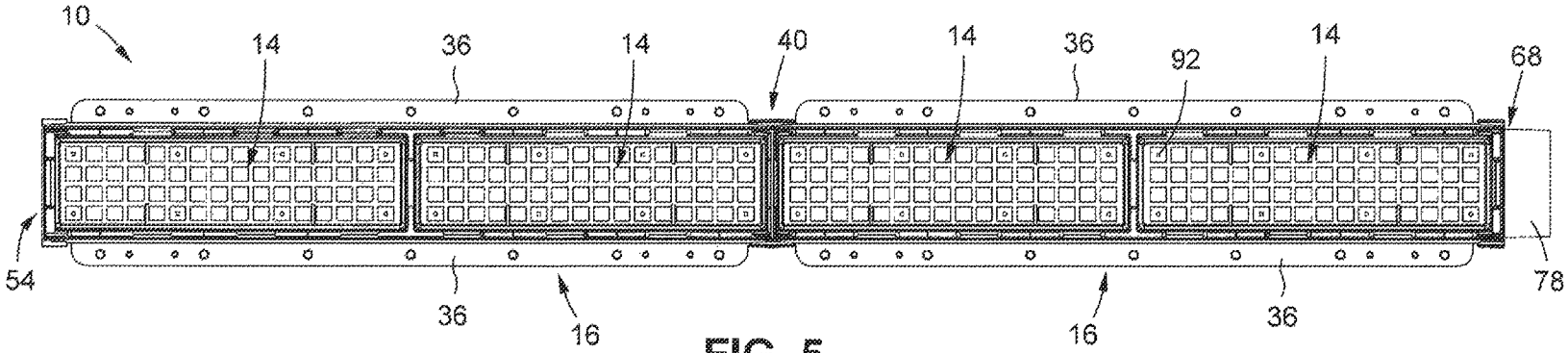
FIG. 5 is a top view of the channel drain of FIG. 2.

FIG. 1 is an upper perspective view of the channel drain 10 installed in the fabricated surface 11, while FIG. 2 shows the channel drain 10 prior to installation in the fabricated surface 11, and FIG. 3 is an upper perspective exploded view of the channel drain 10. In general, the channel drain 10 includes an elongate drain base or trough 12 and a plurality of inserts 14 disposable within the elongate drain base 12. As will be described in more detail below, the elongate drain base 12 and the plurality of inserts 14 define a drainage gap to allow water to flow from the fabricated surface 11 and into the drain base 12.

The elongate drain base 12 may be comprised of a plurality of base bodies 16, e.g., a first body, a second body, etc., which may be interconnected to each other to form the elongate drain base 12. Each base body 16 includes a body lower wall 18 and a pair of body sidewalls 20 extending from opposite ends of the body lower wall 18 in generally opposed relation to each other. Each body sidewall 20 extends upwardly from the body lower wall 18 and terminates at an upper edge 22, which resides in an upper plane, which may be substantially flush with the fabricated surface 11 once installation of the channel drain 10 is complete.

Figure 4:
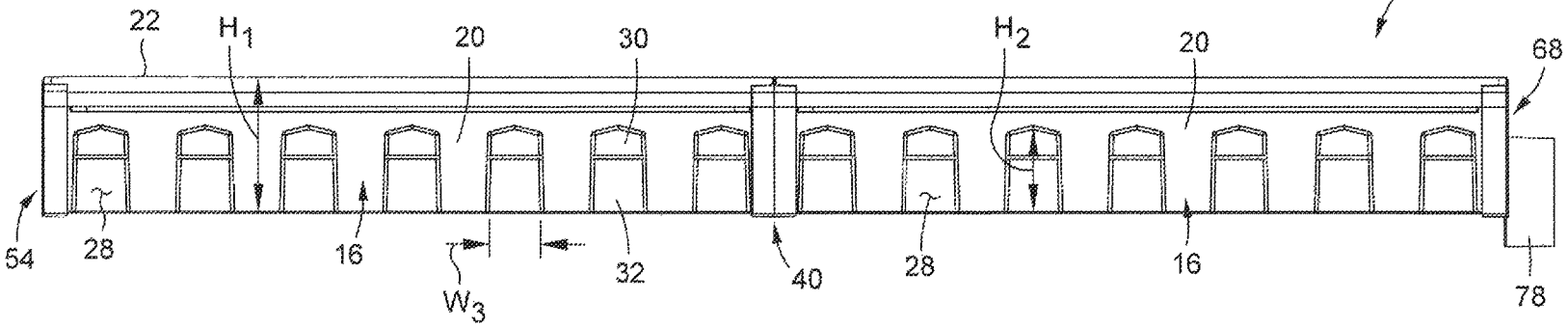
FIG. 4 is a side view of the channel drain of FIG. 2.
Figure 7:
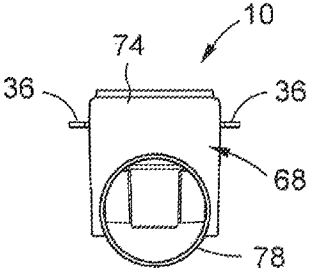
FIG. 7 is a second end view of the channel drain of FIG. 2, showing a drain connecting end of the channel drain.
Figure 6:
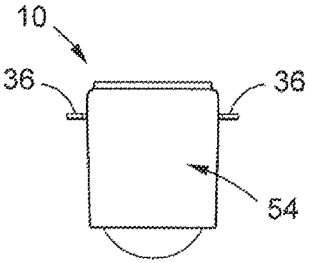
FIG. 6 is a first end view of the channel drain of FIG. 2 showing a closed end of the channel drain.
Figure 10:
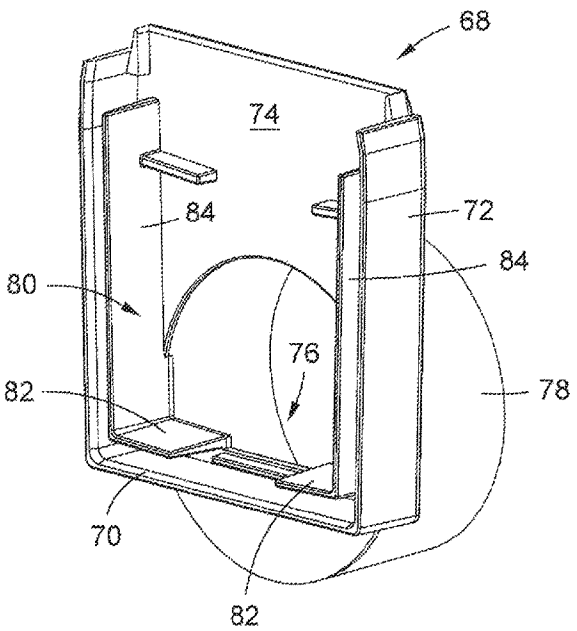
FIG. 10 is an upper perspective view of a drain connector.
Figure 8:
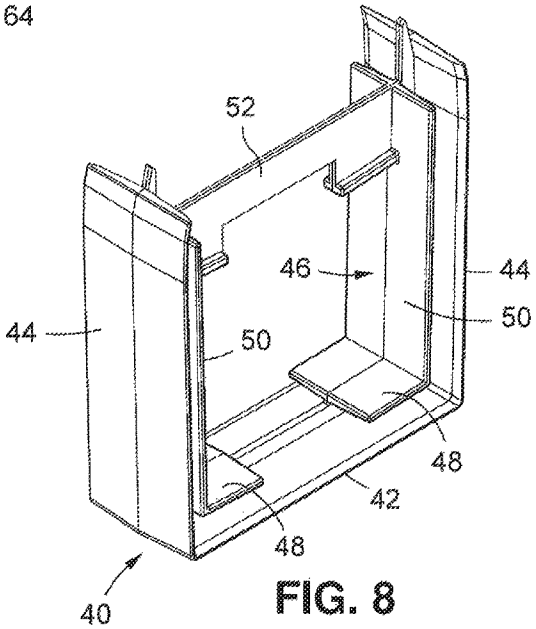
FIG. 8 is an upper perspective view of a base body connector.
Figure 9:
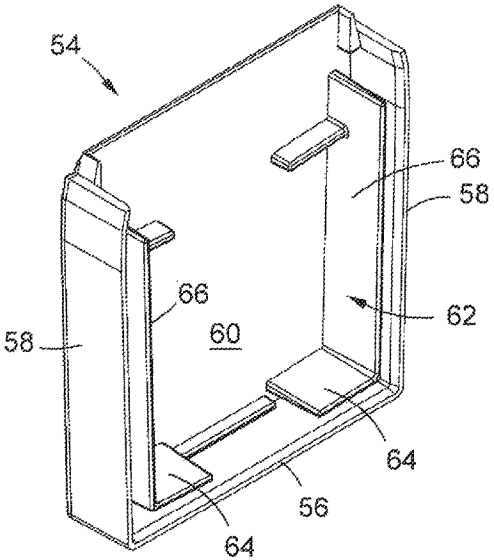
FIG. 9 is an upper perspective view of an end cap.
Figure 12:
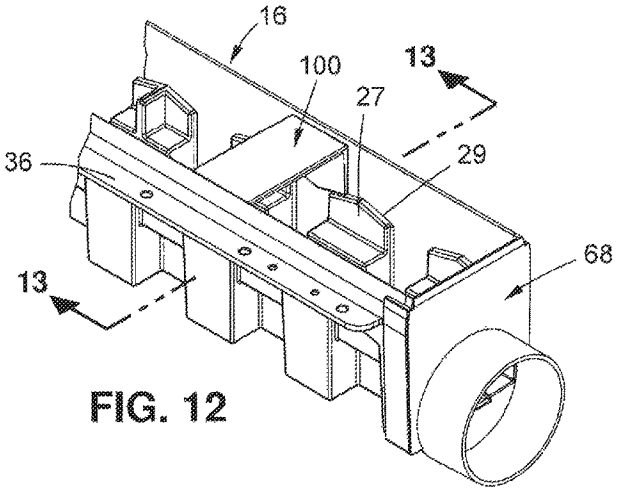
FIG. 12 is a partial upper perspective view of the spacer inserted within the base body.
Figure 13:
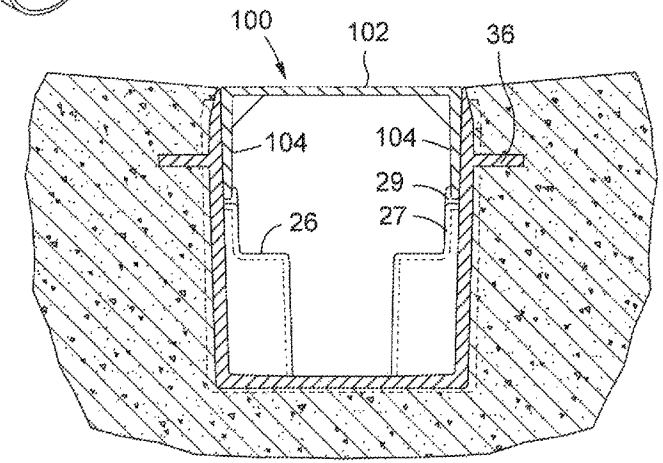
FIG. 13 is a cross sectional view of a material poured around the base body while the spacer is inserted within the base body to provide lateral support thereto.
Figure 11:
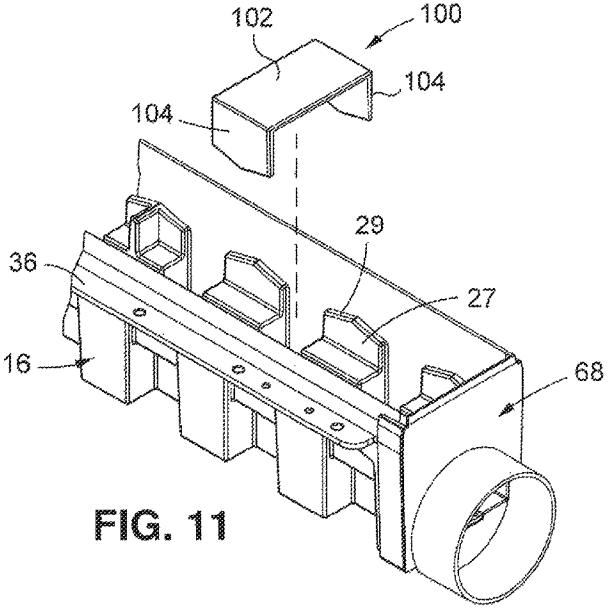
FIG. 11 is a partial upper perspective view of a spacer positioned above a base body.
Figure 15:
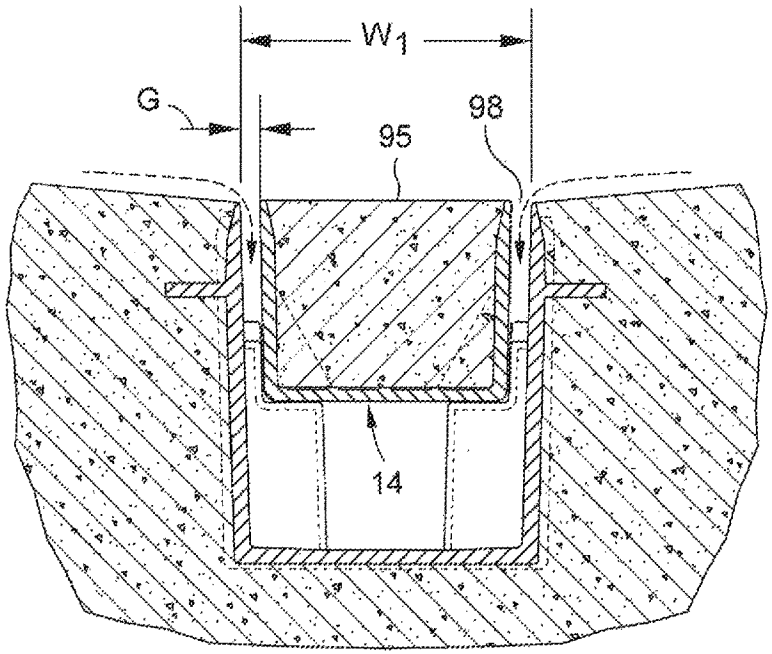
FIG. 15 is a cross sectional view of a filled inserted in the base body; and Common reference numerals are used throughout the drawings and the detailed description to indicate the same elements.

Each base body 16 may define a base body height, "$H_1$" (see FIG. 4) from the outer surface of the body lower wall 18 to the upper edge 22. According to one embodiment, the base body height $H_1$ is in the range of 3.0"-6.0", and in one particular embodiment, the base body height $H_1$ is 4.5". Each base body 16 may define a base body width, "$W_1$," (see FIG. 15) as the distance between the body sidewalls 20. According to one embodiment, the base body width $W_1$ is between 3.0"-5.0", and in one particular embodiment, the base body width $W_1$ is 4.0". Furthermore, the base body 16 may define a base body length, "$L_1$" (see FIG. 3) between opposed ends 24. According to one embodiment, the base body width $L_1$ is between 12.0"-36.0", and in one particular embodiment the base body length $L_1$ is 24.0". The base bodies 16 may be formed from ABS (Acrylonitrile Butadiene Styrene), PVC (Polyvinyl Chloride) or other materials known in the art.

Figure 14:
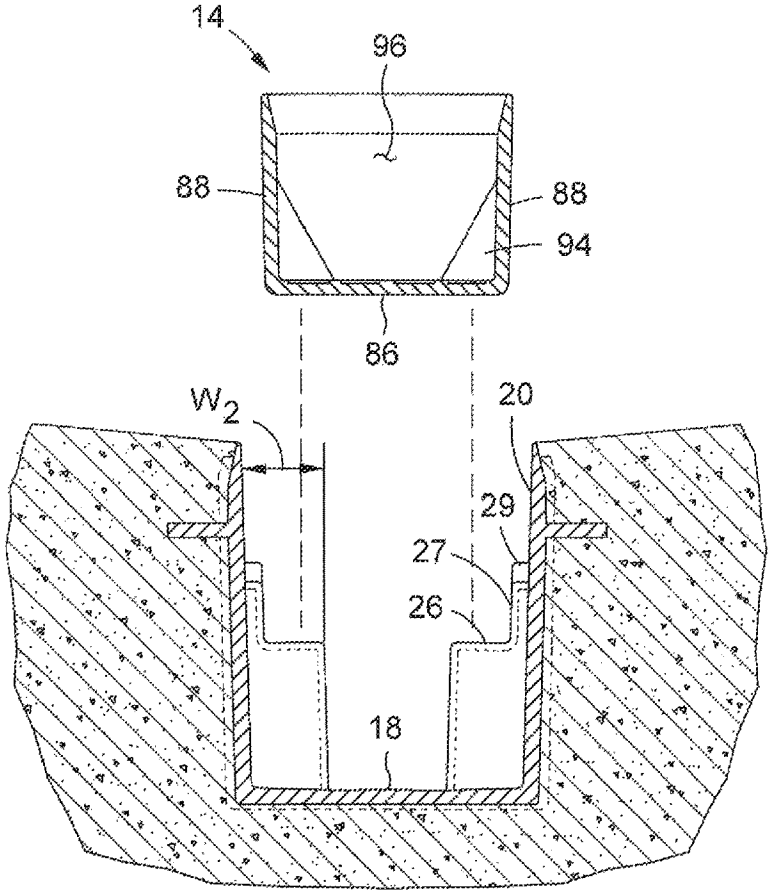
FIG. 14 is a cross sectional view of an empty insert positioned above the base body.

Each base body 16 may additionally include a plurality of support surfaces 26 positioned between the pair of body sidewalls 20 in spaced relation to the body lower wall 18. In one embodiment, each support surface 26 extends from a respective one of the pair of body sidewalls 20, with each body sidewall 20 including a set of support surfaces 26 extending therefrom. The support surfaces 24 are sized and structured to support the inserts 14 when the inserts 14 are placed in the drain base 12, as will be described in more detail below. According to one embodiment, each support surface 26 extends away from a corresponding body sidewall 20 and terminates to define a support surface width, "$W_2$," (see FIG. 14) which may range from 0.5"-1.5", and in one particular embodiment, may be 1.0".

Each base body 16 may further include several projections 27 defining an upper engagement surface 29 having two segments which meet at an apex. Each projection may be located above a corresponding support surface 26, and the importance of the upper engagement surface will be described in more detail below.

Each base body 16 may be specifically contoured to include a plurality of side cavities 28 formed therein, with each side cavity 28 extending into the base body 16 from a respective one of the pair of body sidewalls 20. The side cavities 28 may be sized and structured to allow concrete or other materials used to form the fabricated surface 11 to flow therein for securing the base body 16 within the fabricated surface 11. Each side cavity 28 may include an upper portion and a lower portion, with the upper portion extending from the body sidewall 20 and terminating at an upper surface 30, while the lower portion extends from the body sidewall 20 and terminates at a lower surface 32. The upper surface 30 may be spaced approximately 0.25" from the body sidewall 20, while the lower surface 32 may be spaced approximately 1.0" from the body sidewall 20, and thus, the lower portion of the side cavity 28 may be deeper and define a larger volume than the upper portion of the side cavity 28. According to one embodiment, the upper portion of the side cavity 28 may be sized and structured to define an apex, which may provide strength and durability to the base body 16.

Each side cavity 28 may define a maximum width, "$W_3$" (see FIG. 4) adjacent the body lower wall 18. The maximum width $W_3$ is between 1.25"-2.50", and in one particular, embodiment, the maximum width $W_3$ is 1.80". The width of each side cavity 28 may decrease as the distance from the body lower wall 18 increases. Each side cavity 28 may define a cavity height, "$H_2$" as the distance between the body lower wall 18 and the tip of the apex. The cavity height $H_2$ may be 2.5"-3.5", and in one particular embodiment, the cavity height $H_2$ is 3.0".

Each base body 16 may additionally include at least one divider wall 34 extending inwardly from a body sidewall 20. The divider wall 34 may separate the inserts 14 when they are inserted into the base body 16. In this regard, the position of the divider wall 34 on the base body 16 may correspond to the dimensions of the inserts 14. According to one embodiment, and as shown in FIG. 2, the divider wall 34 may extend upwardly from a support surface 26 to effectively divide that support surface 26 in half. Thus, for the embodiment shown in FIG. 2, each base body 16 is sized and structured to receive a pair of insets 14, with each insert 14 being supported by 3.5 support surfaces 26 on each side.

The base bodies 16 may additionally include at least one, and more preferably, at least one pair of flanges 36 extending from respective ones of the pair of body sidewalls 20. Each flange 36 includes at least one aperture 38 formed therein. The apertures 38 may be used to secure the base body 16 to a form used when pouring concrete or other material when constructing the fabricated surface 11. The apertures 38 may also be used to allow the concrete or other material to flow therein for enhancing the bond between the concrete and the base body 16, as will be described in more detail below.

As noted above, the drain base 12 may include several base bodies 16. Therefore, one embodiment of the channel drain 10 includes a base body connector 40 to facilitate interconnection of two adjacent base bodies 16. According to one embodiment, the base body connector 40 includes a connector lower wall 42, and a pair of connector sidewalls 44 extending from the connector lower wall 42. The base body connector 40 may additionally include an inner engagement element 46 having a pair of lower portions 48, a pair of side portions 50, and an upper portion 52 extending between the pair of side portions 50. The lower portions 48 and side portions 50 may be spaced from the connector lower wall 42 and connector sidewalls 44, respectively, to form a gap within which the end portions of a base body 16 may be receive for frictionally engaging the base body 16. A pair of base bodies 16 may be engaged with opposite sides of the base body connector 40 to interconnect the pair of base bodies 16. It is contemplated that an adhesive or mechanical fasteners known in the art may be used to strengthen the engagement between the base body connector and the base bodies 16.

The ends of the drain base 12 may be closed or connected to a drain pipe to facilitate connection of the channel drain 10 to a drain pipe, sewer, reservoir, or other drainage infrastructure. To close the end of the drain base 12, an end cap 54 may be used. The end cap 54 may include an end cap lower wall 56, a pair of end cap sidewalls 58 extending from the end cap lower wall 56, and an end cap primary wall 60 extending from the end cap lower wall 56 and between the end cap sidewalls 58. The end cap primary wall 60 is sized and structured to extend between the pair of body sidewalls 20 to effectively define a closed end of the drain base 12 when the end cap 54 is connected to a base body 16. The end cap 54 may be structured to engage with a base body 16 in a manner similar to the base body connector 40 described above. Along these lines, the end cap 54 may additionally include an inner engagement element 62 having a pair of lower portions 64, and a pair of side portions 66. The lower portions 64 and side portions 66 may be spaced from the end cap lower wall 56 and end cap sidewalls 58, respectively, to form a gap within which the end portions of a base body 16 may be received for frictionally engaging with the base body 16.

To connect the drain base 12 to a drain pipe, a drain connector 68 may be used. The drain connector 68 includes a lower wall 70 and a pair of sidewalls 72. A primary wall 74 extends between the sidewalls 72 at upper end portions thereof, and a drain opening 76 may be formed in the primary wall 74 adjacent lower end portions of the sidewalls 72. A sleeve 78 may be connected to the primary wall 74 opposite the lower wall 70 and pair of sidewalls 72, with the sleeve 78 being sized and structured to engage with the drain pipe. According to one embodiment, the sleeve 78 is sized to receive an end of the drain pipe and frictionally engage the drain pipe. However, in other embodiments, it is understood that the sleeve 78 may be inserted into the drain pipe for engagement therewith. In one embodiment, the sleeve 78 defines an outer diameter of approximately 3.5 inches.

The drain connector 68 may be structured to engage with a base body 16 in a manner similar to the base body connector 40 described above. Along these lines, the drain connector 68 may additionally include an inner engagement element 80 having a pair of lower portions 82, and a pair of side portions 84. The lower portions 82 and side portions 84 may be spaced from the lower wall 70 and sidewalls 72, respectively, to form a gap within which the end portions of a base body 16 may be received for frictionally engaging with the base body 16.

As noted above, the channel drain 10 further comprises a plurality of inserts 14 insertable into the drain base 12. In the exemplary embodiment, each base body 16 included in the drain base 12 is sized to receive two inserts 14, although it is contemplated that the base bodies 16 and the inserts 14 may be sized to allow for more than two inserts 14 to be received in a given base body 16.

Each insert 14 includes an insert lower wall 86, and a pair of insert sidewalls 88 extending from insert lower wall 86 in opposed relation to each other. The inserts 14 additionally includes a pair of insert end walls 90 extending from the insert lower wall 86 in opposed relation to each other, with each end wall 90 extending between the pair of insert sidewalls 88. The insert lower wall 86 may include one or more openings 92 extending therethrough to allow for drainage of water or other fluid that may undesirably accumulate within the insert 14. Furthermore, one or more strengthening ribs 94 may extend between the sidewalls 88 and the lower wall 86 to provide additional structural support.

The insert lower wall 86, the pair of insert sidewalls 88, and the pair of insert end walls 90 collectively define an insert cavity 96 sized and structured to receive a material to fill the insert cavity 96 and form an insert core 95. According to one embodiment, the material may be a selected material having an appearance substantially identical to the exposed appearance of the fabricated surface 11. In this respect, the appearance of the channel drain 10 may substantially match the appearance of the fabricated surface 11, to allow the channel drain 10 to blend into the fabricated surface 11.

Each insert 14 is sized and structured to be inserted into a base body 16, with the insert 14 being supported by several supported surfaces when inserted in the base body 16. The insert 14 and the base body 16 are cooperatively sized and structured to define a gap 98 between the pair of body sidewalls 20 when inserted into the base body 16, with the gap 98 allowing for fluid to flow therethrough toward the body lower wall 18. Once the fluid passes through the gap 98, the fluid may flow along a drainage flowpath defined by the channel drain 10 and exit via the drain connector 68.

With the basic structure of the channel drain 10 discussed above, the following will provide an explanation of one embodiment of installing the channel drain 10 in the fabricated surface 11, wherein the fabricated surface 11 includes an exposed appearance. The method includes positioning a base body 16 within the fabricated surface 11. In this regard, the term "positioning" is used broadly to include forming the fabricated surface 11 around the base body 16, or placing the base body 16 on an already formed portion of the fabricated surface 11. When the fabricated surface 11 is formed around the base body 16, a form may be used, with the base body 16 being securable to the form by inserting mechanical fasteners (e.g., nails, screws, etc.) into the form via the apertures 38 formed in the flanges 36.

Prior to pouring the material used for the fabricated surface 11 (i.e., the fabricated surface material), one or more spacers 100 may be inserted into the base body 16 to prevent inward flexing or buckling of the body sidewalls 20 when the fabricated surface material is poured around the base body 16. The spacer 100 is engagable with the pair of body sidewalls 20 and is sized and structured to provide lateral support to the pair of body sidewalls 20 to maintain a prescribed distance therebetween. The spacer 100 includes an upper wall 102 and a pair of lateral walls 104 which are sized to be insertable within the base body 16 such that the entirety of the spacer 100 resides between the pair of body sidewalls 20. The terminal end of each lateral wall 104 may include two segments which meet at an apex. The contour of the terminal ends of the lateral walls 104 may be complimentary to the upper engagement surfaces 29 of the projections 27 extending from the body sidewalls 20, such that the spacer 100 is supported by the projections 27 upon insertion of the spacer 100 into the base body 16.

After the spacer(s) 100 are inserted into the base body 16, the fabricated surface material may be poured around the base body 16. If a form is being used, the form may be removed prior to the fabricated surface material rising to the upper portion of the drain base 12. If a form is not being used, some of the fabricated surface material may be poured to provide a base upon which the base bodies 16 may be placed.

The fabricated surface material is poured until it fills in around the base bodies 16 and is substantially flush with the upper edge of the base bodies 16. In this regard, it is understood that the fabricated surface 11 may be graded to slope toward the channel drain 10, and as such, the fabricated surface 11 is considered to be substantially flush with the upper edge of the base bodies 16 when the height of the area of the fabricated surface 11 immediately adjacent the base bodies 16 is substantially equal to the height of the upper edge of the base bodies 16. As the fabricated surface materials is poured around the base bodies 16, some of the fabricated surface material may flow through the apertures 38 in the flanges 36 to create uniformity through the flanges 36 to enhance the bond between the base bodies 16 and the fabricated surface material. Once the fabricated surface 11 is poured around the base bodies 16, the fabricated surface 11 is allowed to harden, to secure the base bodies 16 within the fabricated surface 11.

In addition to pouring fabricated surface material around the base bodies 16, the method may additionally include pouring fabricated surface material within the cavity 96 of the inserts 14. The fabricated surface material is poured within the cavity 96 until the cavity 96 is filled and is substantially flush with the upper edge of the insert 14. The fabricated surface material is allowed to harden within the insert 14 to form an insert core 95.

The insert 14 may be inserted into a respective one of the base bodies 16, such that the insert 14 is supported by the support surfaces 26 on the base body 16 and the gap 98 is formed between the inserts 14 and the base body 16. With the fabricated surface material being located around the drain base 12 and within the inserts 14, there is a substantially continuous appearing surface formed, which is only minimally interrupted by the gap 98. As such, the channel drain 10 may blend into the fabricated surface 11, without creating an undesirable appearance.

Although the foregoing describes the material poured in the insert as being the same as the material used to form the fabricated surface 11, it is understood that the scope of the present disclosure is not limited thereto. In this respect, different materials may be used without departing from the spirit and scope of the present disclosure. Such different materials may have similar appearance, different appearances, complimentary appearances or contrasting appearances.

As used herein, the term "substantially" allows for variance and tolerances acceptable within the art.

The particulars shown herein are by way of example only for purposes of illustrative discussion, and are not presented in the cause of providing what is believed to be most useful and readily understood description of the principles and conceptual aspects of the various embodiments of the present disclosure. In this regard, no attempt is made to show any more detail than is necessary for a fundamental understanding of the different features of the various embodiments, the description taken with the drawings making apparent to those skilled in the art how these may be implemented in practice.

What is claimed is:

1. A channel drain for use in a fabricated surface, the channel drain comprising:

a first body having:

a body lower wall;

a pair of body sidewalls extending from the body lower wall in opposed relation to each other;

a first set of support surfaces spaced from each other and extending from a first one of the pair of body sidewalls; and a second set of support surfaces spaced from each other and extending from a second one of the pair of body sidewalls; and a plurality of inserts insertable into the first body, each insert having:

an insert lower wall; and a pair of insert sidewalls extending from the insert lower wall in opposed relation to each other, the pair of insert sidewalls and the insert lower wall at least partially defining an insert cavity sized and structured to receive a selected material having an appearance substantially identical to the fabricated surface;

each insert being supported by at least one of the first set of support surfaces and at least one of the second set of support surfaces when inserted into the first body and being sized and structured to define a gap between the pair of body sidewalls when inserted into the first body, the gap allowing for fluid to flow therethrough toward the body lower wall.

2. The channel drain recited in claim 1, wherein the first body includes a plurality of side cavities, each side cavity extending into the first body from a respective one of the pair of body sidewalls.

3. The channel drain recited in claim 1, further comprising a pair of flanges extending from respective ones of the pair of body sidewalls, each flange having at least one aperture formed therein.

4. The channel drain recited in claim 1, further comprising an end cap engageable with the body lower wall and the pair of body sidewalls and extending between the pair of body sidewalls when engaged therewith.

5. The channel drain recited in claim 1, further comprising a drain connector engageable with the body lower wall and the pair of body sidewalls, the drain connector having:

a primary wall extending between the pair of body sidewalls, the primary wall having a drain opening formed in the primary wall; and a sleeve extending from the primary wall and in fluid communication with the drain opening.

6. The channel drain recited in claim 1, further comprising a spacer engageable with the pair of body sidewalls, the spacer being sized and structured to provide lateral support to the pair of body sidewalls to maintain a prescribed distance therebetween.

7. The channel drain recited in claim 1, further comprising a second body connectable to the first body, the second body having:

a second body lower wall;

a pair of second body sidewalls extending from the body lower wall in opposed relation to each other; and a plurality of second body support surfaces, each second body support surface extending from a respective one of the pair of body sidewalls in spaced relation to the body lower wall.

8. The channel drain recited in claim 7, further comprising a connector frictionally engageable with the second body and the first body to facilitate connection of the second body to the first body.

9. The channel drain recited in claim 1, wherein each insert includes at least one aperture formed in the insert lower wall.

10. A channel drain for use in a fabricated surface formed of a selected material, the channel drain comprising:

a main body having an upper edge and defining a drainage flowpath, the main body being positionable in the fabricated surface such that the upper edge is substantially flush with the fabricated surface, the main body having a first set of support surfaces spaced from each other, and a second set of support surfaces spaced from each other in opposed relation to the first set of support surfaces; and a plurality of inserts insertable into the main body and engageable with at least one of the first set of support surfaces and at least one of the second set of support surfaces, each insert having a cavity sized and configured to receive the selected material to create an exposed surface substantially identical to the fabricated surface;

the main body and the plurality of inserts collectively defining a gap between the plurality of inserts and the main body when the plurality of inserts are inserted within the main body, the gap being sized and structured to allow for fluid drainage therethrough to the drainage flowpath in the main body.

11. The channel drain recited in claim 10, wherein the main body includes opposed lateral portions and a plurality of recesses, each recess extending into the main body from a respective one of the lateral portions.

12. The channel drain recited in claim 10, further comprising a pair of flanges extending from opposed portions of the main body, each flange having at least one aperture formed therein.

13. The channel drain recited in claim 10, further comprising a drain connector engageable with the main body, the drain connector having:

a primary wall extending at least partially across the main body, the primary wall having a drain opening formed therein; and a sleeve extending from the primary wall and in fluid communication with the drain opening.

14. The channel drain recited in claim 10, wherein each insert includes an insert lower wall and at least one aperture formed in the insert lower wall.

15. A method of installing a channel drain in a fabricated surface, the method comprising the steps of:

positioning a first body within the fabricated surface, the first body comprising:

a body lower wall;

a pair of body sidewalls extending from the body lower wall in opposed relation to each other;

a first set of support surfaces spaced from each other and extending from a first one of the pair of body sidewalls; and a second set of support surfaces spaced from each other and extending from a second one of the pair of body sidewalls; and a plurality of support surfaces, each support surface extending from a respective one of the pair of body sidewalls in spaced relation to the body lower wall; and inserting a plurality of inserts within the first body, each insert having:

an insert lower wall; and a pair of insert sidewalls extending from the insert lower wall in opposed relation to each other, the pair of insert sidewalls and the insert lower wall at least partially defining an insert cavity sized and structured to receive a selected material having an appearance substantially identical to the fabricated surface;

each insert being supported by at least one of the first set of support surfaces and at least one of the second set of support surfaces when inserted into the first body and being sized and structured to define a gap between the pair of body sidewalls when inserted into the first body, the gap allowing for fluid to flow therethrough toward the body lower wall.

16. The method recited in claim 15, wherein the positioning step includes:

attaching the first body to a concrete form; and pouring concrete adjacent the first body to form the fabricated surface.

17. The method recited in claim 16, wherein the positioning step further includes:

inserting a spacer within the first body prior to pouring the concrete, the spacer being sized and structured to provide lateral support to the pair of body sidewalls to maintain a prescribed distance therebetween while concrete is poured adjacent the first body.

18. The method recited in claim 15, further comprising the step of forming the fabricated surface, and wherein the positioning step includes inserting the first body within the fabricated surface after forming the fabricated surface.

19. The method recited in claim 15, further comprising the step of disposing the selected material in the insert cavity of each insert.

* * * * *